United States Patent [19]

Bova

[11] Patent Number: 4,500,380

[45] Date of Patent: Feb. 19, 1985

[54] METHOD AND APPARATUS FOR CONTINUOUS PRODUCTION OF EXPANDABLE HONEYCOMB

[76] Inventor: Joseph D. Bova, 2104 Harford Rd., Fallston, Md. 21047

[21] Appl. No.: 563,199

[22] Filed: Dec. 19, 1983

[51] Int. Cl.[3] ..... B31D 3/02

[52] U.S. Cl. ..... 156/197; 156/204; 156/222; 156/227; 156/264; 156/277; 156/443; 156/459; 156/499; 156/510

[58] Field of Search ..... 156/197, 204, 210, 222, 156/227, 256, 257, 264, 277, 443, 459, 499, 510

[56] References Cited

U.S. PATENT DOCUMENTS

| | | | |
|---|---|---|---|
| 2,581,421 | 1/1952 | Lombard et al. | 156/204 |
| 2,734,843 | 2/1956 | Steele | 156/197 |
| 2,983,640 | 5/1961 | Knoll et al. | 156/264 |
| 3,166,456 | 1/1965 | White et al. | 156/197 |
| 3,242,024 | 3/1966 | Bova et al. | 156/197 |
| 3,458,385 | 7/1969 | Bova et al. | 156/197 |
| 3,519,510 | 7/1970 | Ardolino et al. | 156/197 |
| 3,637,448 | 7/1972 | Siegal et al. | 156/197 |
| 4,290,837 | 9/1981 | Bova | 156/197 |

*Primary Examiner*—Caleb Weston

[57] ABSTRACT

A method of printing adhesive lines on a narrow and flexible ribbon-type material, whereby the adhesive lines are linearly spaced and applied transversely to both sides of the ribbon at the same time; and the relationship of the lines on the obverse side to the lines on the reverse side are staggered, with each side maintaining equal spaces between the lines. The preferred apparatus for performing the method of two-sided simultaneously printing is a rotogravure offset method which includes two rotogravure rolls and two rubber rolls, with each rubber roll resting on each rotogravure roll in pyramid fashion, whereby the two rubber rolls simultaneously make an impression on the ribbon material moving between them as they rotate. Downstream from the printing station, a bar, having blades mounted on each end, rotates and strikes the printed ribbon against a cutting anvil; this only partially cuts the ribbon, so that it maintains its continuity; and as it fan-folds, the adhesive lines mate exactly, line on line, from the same side of the ribbon, and it descends to a flat-folded position between guide pins on a horizontal press-bar. After the desired number of ribbon folds is reached, another press-bar is placed on top of the folded ribbon and heat is applied; and later, the bonded plies are expanded, forming honeycomb.

14 Claims, 5 Drawing Figures

II-II

METHOD AND APPARATUS FOR CONTINUOUS PRODUCTION OF EXPANDABLE HONEYCOMB

BACKGROUND OF THE INVENTION

The invention relates generally to the production of expandable type honeycomb and more particularly to an innovative method and apparatus that will produce in a single assembly fixture a honeycomb panel expanded to its finished dimension. This new method reduces many of the operations and much of the equipment used in present day practices.

DESCRIPTION OF THE PRIOR ART

Expandable type honeycomb core material is generally made by using a batch process wherein wide sheets are cut from the printed web. The separate sheets are arranged so that the adhesive lines are alternately staggered from sheet to sheet to form a stack. The stack of printed sheets is then placed in a heated platen press to bond and cure the glue lines. The wide bonded block is then taken to a sawing operation where slices are cut from the block to the desired width. This creates a saw-kerf material loss of more than 1/32" for each slice and the sawing operation is very slow. After sawing, the slices are taken to a pin-nailing jig where pins resembling finishing nails are hammered manually, one at a time, through the two edges of the slice. These pins are approximately three inches apart and are later used to restrain the edges of the unexpanded honeycomb while the cells in the slice are opened on the expanding mechanism. These prior art methods that use wide block manufacturing require large inventories of different material gauges, different alloys, and varying cell sizes.

Similar methods are described in my previous U.S. Pat. Nos. 3,403,542; 3,242,024; 3,458,385; and 4,290,837. Other variations for producin honeycomb are shown in U.S. Pat. Nos. 2,636,540; 2,649,131; 2,734,843; 2,983,640; 2,993,525; 3,114,666. Batch making of honeycomb, as previously described, has many disadvantages. Accordingly, a general object of this invention is to produce expandable honeycomb in a continuing process. More particularly, an object is to produce the expandable type honeycomb in its final desired form, in one fixutre, at the same station, thus eliminating much of the labor and different machines required in present day operations.

SUMMARY OF THE INVENTION

The above and further objects and novel features are accomplished by pre-slitting the wide web of thin material into ribbons of the exact dimension required when the honeycomb is expanded. Standard slitting machines run at exceedingly fast speeds, and this operation eliminates the old slow tedious method of sawing each slice. By using narrow ribbons of thin material, the machines for processing these ribbons are small. Therefore a battery of machines can be operating simultaneously, producing slices of honeycomb to any desired dimension. In this operation the ribbon is pulled through the double-offset gravure printing apparatus which applies adhesive lines on both sides of the ribbon. These adhesive lines are printed on the obverse side in a staggered relationship to the lines printed on the reverse side. As the ribbon travels past the anvil blade and the cutting blade, it is partially severed, allowing the ribbon to maintain its continuity and be fan-folded so the adhesive lines will be mated line on line.

After the required number of folds have been made, the stack is automatically moved aside and another press-stacking-bar assembly is moved into position and the printing and folding operation continues. The press-stacking-bar that has been moved aside with the completed fan-folded stack is then enclosed by another press-bar which is placed on top of the stack; and after pressing, the bonded ribbons are expanded. Thus all operations are accomplished in the same fixture, eliminating many of the cumbersome procedures as well as the extra equipment and labor needed in prior art methods. The above and further objects and novel features of the invention will be readily understood from the following detailed description when read in connection with the accompanying drawings. It should be understood, however, that the drawings are not intended as a complete definition of the invention but are for the purpose of illustration only.

BRIEF DESCRIPTION OF THE DRAWINGS

In the drawings where like parts are marked alike.

DESCRIPTION OF THE PREFERRED EMBODIMENT

Figure 1:
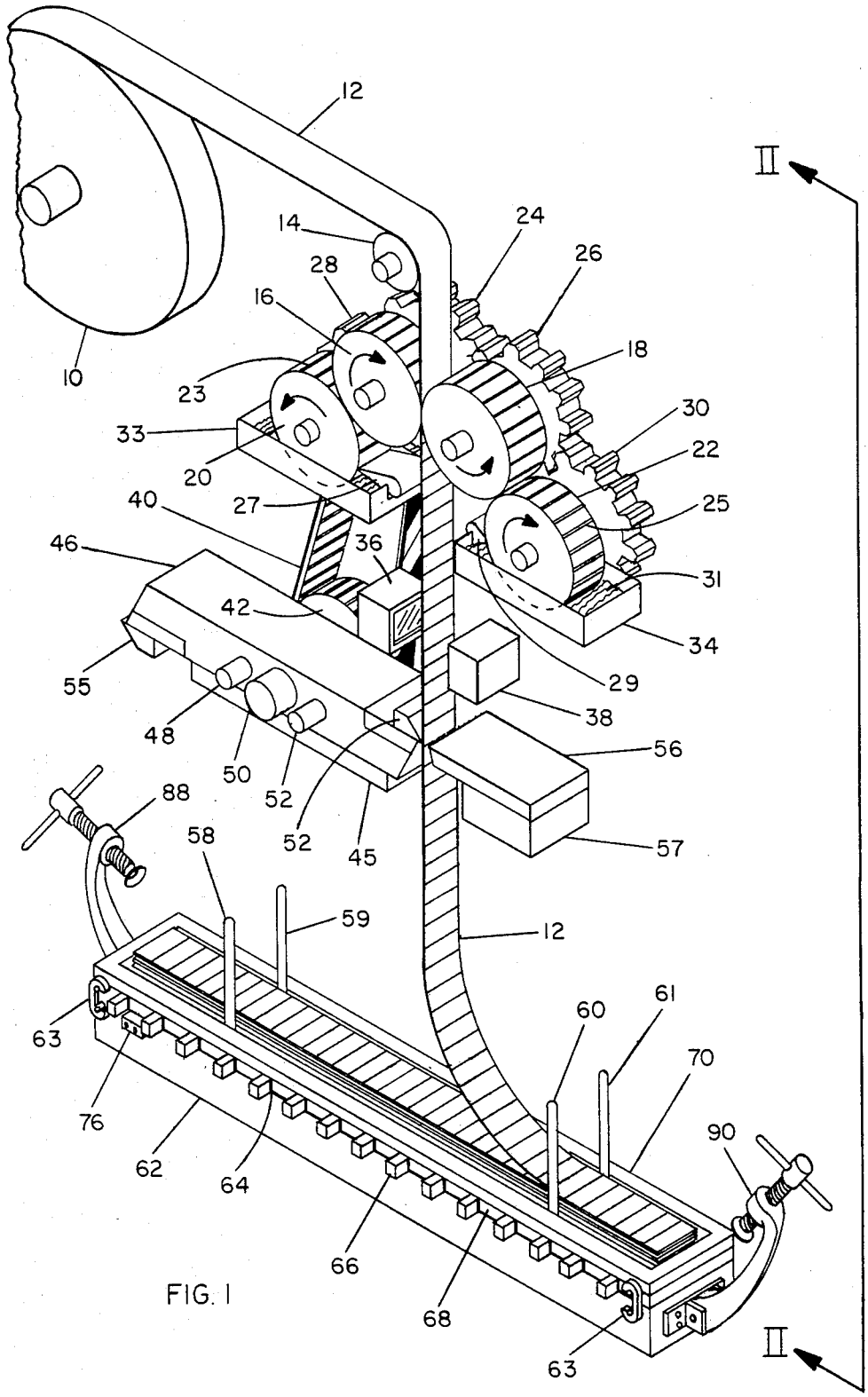
FIG. 1 is a schematic illustration in side elevation of the invention, showing the path of travel of the ribbon medium from the supply spool to the idler roll and then downward between the gravure offset printing rolls, where the adhesive lines are printed on both sides of the ribbon medium. It then passes by the heating lamps for preliminary drying to prevent smearing as it passes through the cutting station, where the ribbon is partially severed in order to maintain its continuity as it fan-folds between the guide rods onto the press-stacking-bar.
Figure 2:
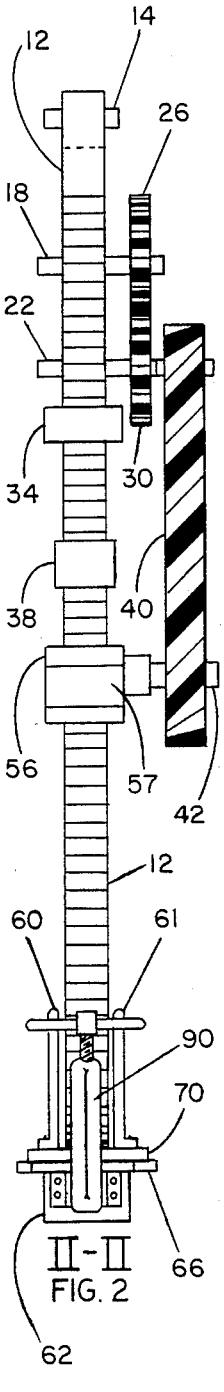
FIG. 2 is an end view taken along the lines of II—II, showing the ribbon over the top of the idler roll then passing into the gravure offset printing rolls and also showing the gears on one side; with the said ribbon moving thru the heat lamp area to dry the adhesive. The printed ribbon then goes by the anvil and cutting blade, after which the ribbon medium begins to fan-fold as it continues on downward by gravity and falls between guide pins onto the press-stacking bar.
Figure 3:
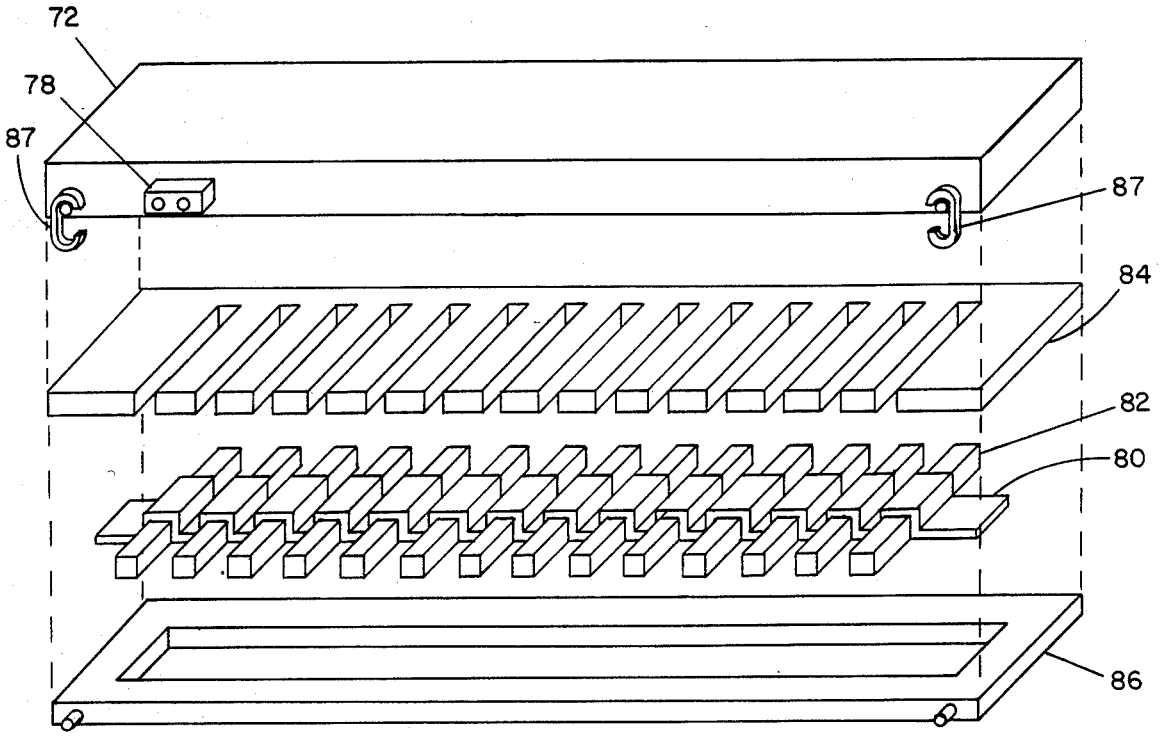
FIG. 3 is a schematic illustration showing an exploded view of the upper press-bar, the slotted spacer plate, the web bonding medium, tug-pins and restraining frame.
Figure 4:
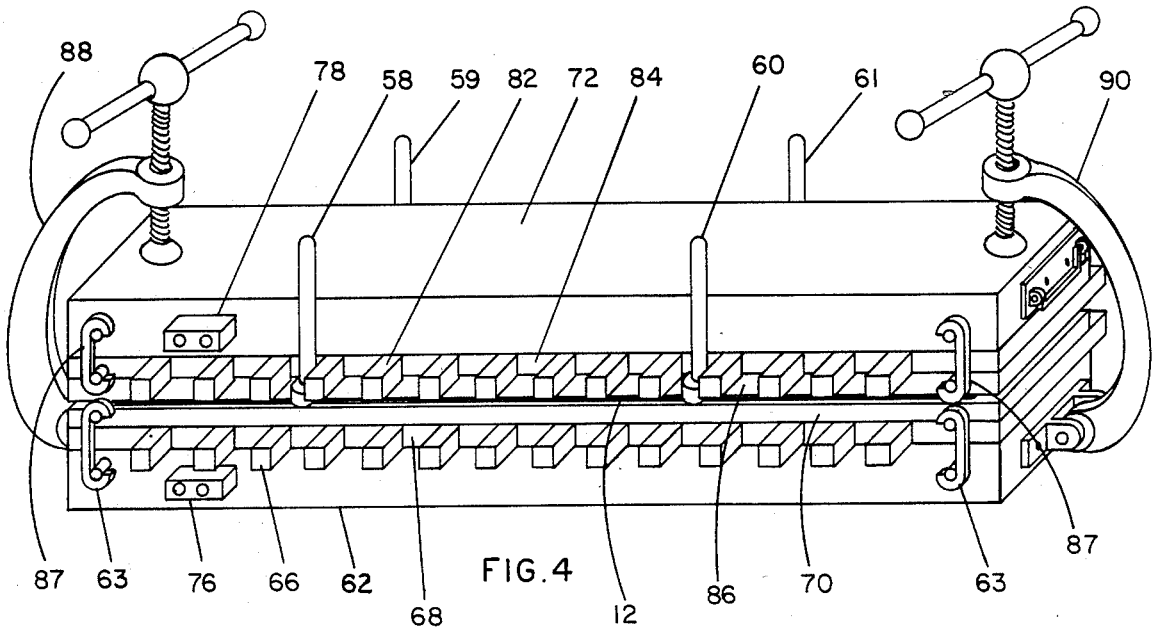
FIG. 4 is a schematic illustration showing the completed fan-folded stack between two press-bars, two slotted spacer plates, two restraining frames, together with the tug-pins, clamping arrangement and heating element.
Figure 5:
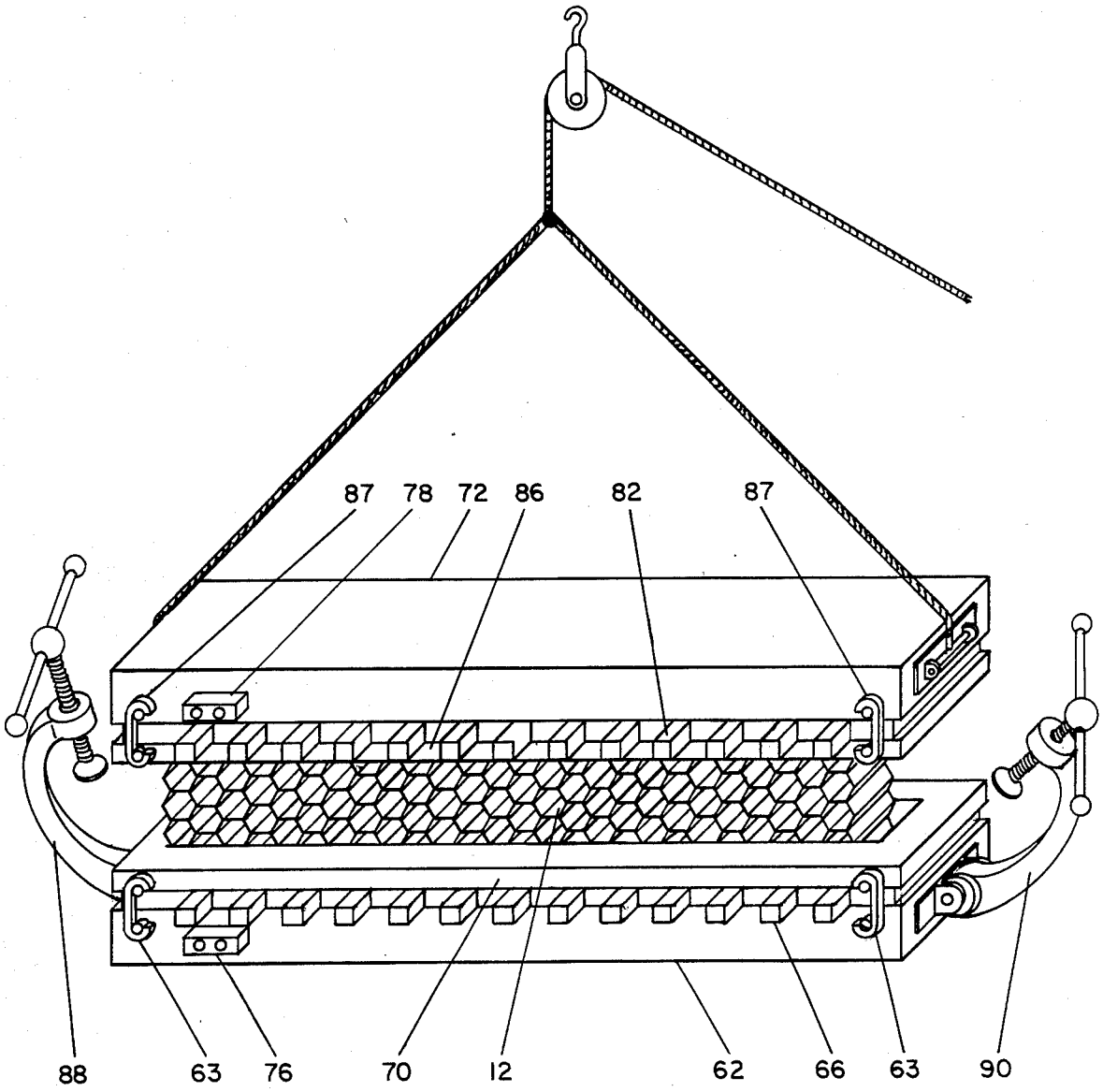
FIG. 5 is a schematic illustration in side elevation showing the clamps in a released position and the top press-bar raised by a pulley arrangement, with the honeycomb cells expanded.

The preferred apparatus for practicing the invention is generally illustrated in FIG. 1 and FIG. 2. Referring to FIG. 1, the ribbon medium 12, which is a thin web material made of plastic, woven fiberglass, aluminum, or any other suitable metal alloy, passes from spool 10, over idler roll 14, then downward between the rubber offset printing rolls 16 and 18. The two gravure rolls 20 and 22 are partially immersed in liquid adhesive 31, which is contained in pans 33 and 34; as the two said gravure rolls revolve, the said adhesive is wiped into the minute gravure cell lines 23 and 25 by doctor blades 27 and 29. These said gravure cell lines transfer the adhesive to the said rubber offset rolls 16 and 18 which in turn print the said lines on both sides of the said ribbon medium 12. It is then heated by quartz lamps 36 and 38 to prevent smearing as it travels through the cutting bar 46, which includes a shear type cutting blade 54 on one end and another shear type cutting blade 55 on the opposite end. This said cutting assembly 46,54 and 55 is mounted to gear 42, on two locating pins 48 and 52, and rotates on shaft 50. Said cutting assembly moves against the fixed shear type anvil blade 56, which is suitably mounted to a horizontally adjustable base plate 57. The effective length of cut can be doubled by removing one or the other of the said cutting blades 54 or 55. As will be understood by those skilled in the art, intermediate cutting lengths can be accomplished by using cutting bar assemblies having different lengths, with the same locating hole dimensions to fit on locating pins 48, 52 and the shaft 50. The timing gear 42 is suitably mounted on base plate 45 and can be positioned, in or out, to the required distance from the anvil blade 56. Changes for varying cut lengths also require timing belts to match. The ribbon medium 12 is only partially cut, (this is accomplished by indentations in knife blades 54 and 55), and thus allows said ribbon medium 12 to maintain its continuity and fan-fold between the guide pins 58, 59, 60 and 61. Magnetic bases are part of these said guide pins, so they can be moved to accommodate various ribbon widths. The restraining frame 70 holds the bonding web 64, tug pins 66, and spacer plate 68 in place and their function together with clamps 88 and 90 will be completely described in FIG. 4 and FIG. 5. FIG. 2 is an end view of the apparatus of FIG. 1, taken along lines II—II, showing the ribbon medium 12 descending from idler roll 14 and passing rubber offset roll 18, gravure roll 22, glue pan 34, quartz lamp 38, anvil blade 56, anvil mounting plate 57; with said ribbon median 12, going between guide rods 60 and 61 and restraining frame 70, which lies on tug pins 66, and said tug pins in turn rest on press-stacking-bar 62; with clamp 90 in the forefront. FIG. 3 shows a schematic exploded view of upper press-bar 72, spacer plate 84, and bonding web 80; which is pre-formed to wrap over tug pins 82. Restraining frame 86 will be fastened to press-bar 72 by holding clips 87 when all parts are assembled in the pressing position. FIG. 4 is a schematic view showing the closed assembly; starting at the bottom with press-bar 62, heating element 76, lower tug pins 66, lower apacer plate 68, lower restraining frame 70, ribbon medium 12, upper restraining frame 86, upper spacer plate 84, upper tug pins 82, upper press-bar 72, heating element 78, guide pins 58, 59, 60, and 61 with clamps 88 and 90 in pressing position. Said lower restraining frame 70 is held to said lower press-bar 62 by clips 63; said upper restraining frame 86 is held to said upper press-bar 72 by clips 87. FIG. 5 is a schematic view of the complete assembly and is shown in the state of partial expansion of the ribbon medium 12 being formed into hexagons. Restraining frame 70, attached to press-bar 62 by clips 63, holds tug pins 66 in place. Restraining frame 86, attached to press-bar 72 by clips 87, holds tug pins 82 in place. Web binding material 80, shown in FIG. 3, is bonded to the top and bottom surface of ribbon medium 12 during the pressing operation; thus the top and bottom surfaces of said ribbon medium 12 are secured while the honeycomb is being expanded. Said restraining frames 70 and 86 do not hold said tug pins 66 and 82 tightly; this allows the said tug pins to purse inward during the expansion of the honeycomb.

Thus having described the invention in its best embodiment and mode of operation, that which is desired to be claimed by Letters Patent is:

1. A method of forming an expanded honeycomb panel comprising the steps of:

a. printing laterally extending and linearly spaced first lines of adhesive on a first side of a moving strip of narrow material;

b. printing laterally extending and linearly spaced second lines of adhesive on a second side of said strip opposite said first side with said second lines being evenly linearly offset with respect to said first lines;

c. transversely notching said strip in parallel with said lines of adhesive at intervals along its length to form succeeding portions of said strip of a desired length between said notches;

d. fan folding succeeding portions of said strip to form a collapsed panel of said succeeding portions;

e. securing a first of said succeeding portions to a first spreading means and securing a last of said succeeding portions to a second spreading means spaced from said first spreading means;

f. heating said first and last succeeding portions in an amount and for such time sufficient to cure all of said adhesive lines between said succeeding portions of said collapsed panel to bond said succeeding portions to each other in the area of said adhesive lines; and g. spreading said first and second spreading means apart to expand said collapsed panel to form an expanded honeycomb panel.

2. The method of claim 1 further including the step of:

heating said first and second printed lines of adhesive on said moving strip sufficient to dry said adhesive prior to said notching of said strip.

3. The method of claim 1 wherein step e. comprises:

securing a first of said succeeding portions to a plurality of linearly spaced first tug pin means and a last of said succeeding portions to a plurality of linearly spaced second tug pin means.

4. The method of claim 3 further including the step of:

bonding a first strip of web binding material to said first succeeding portion and said first tug pin means and bonding a second strip of web binding material to said last succeeding portion and said second tug pin means.

5. The method of claim 4 further including the step of:

clamping said succeeding portions tightly together during heating thereof.

6. Apparatus for forming an expanded honeycomb panel comprising:

printing means for printing laterally extending and linearly spaced first lines of adhesive on a first side of a moving strip of narrow material and printing laterally extending and linearly spaced second lines of adhesive on a second side of said strip opposite said first side, said second lines of adhesive being evenly linearly offset with respect to said first lines; notching means linearly spaced from said printing means and operating in synchronism therewith for forming transverse notches in said strip parallel to said lines of adhesive at intervals along its length to form succeeding portions of said strip of a desired length between said notches;

a first spreading means for receiving and holding a first of and succeeding ones of said said succeeding portions fanfolded between said notches to form a collapsed panel of said succeeding portions on said first spreading means;

a second spreading means spaced from said first spreading means for holding a last of said succeeding portions of said collapsed panel; heating means operative in connection with said first and second spreading means for applying heat to said first and last succeeding portions in an amount and for such time sufficient to cure all of said adhesive lines between said succeeding portions of said collapsed panel to bond said succeeding portions to each other in the area of said adhesive lines; and expanding means attached to said second spreading means for moving said second spreading means away from said first spreading means to expand said collapsed panel to form an expanded honeycomb panel.

7. The apparatus of claim 6 herein:

said notching means includes an anvil means adjacent to said first side of said moving strip; and a notching bar adjacent to said second side of said moving strip, said notching bar having at least one notching blade thereon rotatable with said notching bar into notching engagement with said strip and against said anvil to form such notches in said strip.

8. The apparatus of claim 6 further including:

heating means adjacent to said moving strip between said printing means and said notching means for drying said adhesive lines on said strip sufficient to prevent smearing of said adhesive lines on said moving strip.

9. The apparatus of claim 6 wherein:

said first spreading means includes a plurality of first tug pins adapted for attachment at spaced intervals to said first succeeding portion; and said second spreading means includes a plurality of second tug pin means adapted for attachment at spaced intervals to said last succeeding portion;

said first and second tug pins being operable, upon movement of said second spreading means away from said first spreading means, to extend said collapsed panel.

10. The apparatus of claim 9 wherein:

said first spreading means further includes a first spacer plate means for holding a first linearly extending bonding web against said first tub pins and against said first succeeding portion to bond said first tug pins to said first succeeding portion during heating of said succeeding portions by said heating means; and said second spreading means further includes a second spacer plate means for holding a second lineally extending bonding web against said second tug pins and against said last succeeding portion during heating of said succeeding portions by said heating means.

11. The apparatus of claim 10 wherein:

said first spreading means includes a first restraining frame for holding said first tug pins in alignment with said first succeeding portion during expansion of said collapsed panel;

and said second spreading means includes a second restraining frame for holding said second tug pins in alignment with said last succeeding portion during expansion of said collapsed panel, both of said first and second restraining frames being releasably secured to said first and second spreading means respectively.

12. The apparatus of claim 11 further including:

clamping means attached to said first spreading means and adapted for clamping engagement with said second spreading means for pressing said succeeding portions into firm engagement during heating thereof by said heating means.

13. The apparatus of claim 12 wherein:

said heating means comprises a heating element attached to each of first and second spreading means for heating first and second press bar portions of said spreading means to transfer heat from said press bar portions to said succeeding portions of said strip to bond said succeeding portions together in the area of said adhesive lines.

14. The apparatus of claim 13 wherein:

said spreading means includes pulley and cable means attached to said second spreading means for pulling said second spreading means away from said first spreading means to expand said collapsed panel into an expanded honeycomb panel.

* * * * *